US006615733B2

(12) United States Patent
Kowada

(10) Patent No.: US 6,615,733 B2
(45) Date of Patent: Sep. 9, 2003

(54) TEMPERATURE CONTROL METHOD OF HEAT DEVELOPING APPARATUS AND HEAT DEVELOPING APPARATUS

(75) Inventor: Kazuteru Kowada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/076,444

(22) Filed: Feb. 19, 2002

(65) Prior Publication Data

US 2002/0112635 A1 Aug. 22, 2002

(30) Foreign Application Priority Data

Feb. 20, 2001 (JP) ..... 2001-043548

(51) Int. Cl.[7] ..... G03G 15/00; B41F 23/04
(52) U.S. Cl. ..... 101/488; 399/44; 399/69
(58) Field of Search ..... 101/484, 483, 101/DIG. 29, 487, 488; 399/44, 69; 355/405, 30; 347/191

(56) References Cited

U.S. PATENT DOCUMENTS 4,054,380 A * 10/1977 Donohue et al. ..... 399/21
4,596,991 A * 6/1986 Adomkaitis et al. ..... 347/183
5,060,572 A * 10/1991 Waizmann ..... 101/484
5,170,210 A * 12/1992 Saruwatari ..... 399/44
5,540,152 A * 7/1996 DeMoore ..... 101/483
5,774,204 A * 6/1998 Suzuki et al. ..... 355/27
5,966,557 A * 10/1999 Wada ..... 399/44
6,047,144 A * 4/2000 Sasai et al. ..... 399/44
6,163,662 A * 12/2000 Martin et al. ..... 394/45
6,253,037 B1 * 6/2001 Park ..... 399/44
6,389,241 B1 * 5/2002 Cernusak et al. ..... 399/44

* cited by examiner

*Primary Examiner*—Eugene H. Eickholt
(74) *Attorney, Agent, or Firm*—Sughrue Mion, PLLC

(57) ABSTRACT

A temperature control method of the heat developing apparatus to develop the heated developing sheet on which a latent image by the exposure is formed while the sheet is conveyed in the heat processing section 13, wherein the temperature detection is conducted by the first sensor 71 which is provided on the opening and closing cover, and exposed toward the outside of the apparatus when the opening and closing cover is opened. Simultaneously, the temperature detection is conducted by the second sensor 73 provided at a portion of the heat processing section 13 which is not exposed toward the outside of the apparatus even when the opening and closing cover is opened. Then, according to the optimum control variable corresponding to respective combinations of the temperature lowering amount detected by the previously stored first sensor 71 and second sensor 73, the temperature control of the heat processing section 13 is conducted at the time of the start of apparatus operation.

8 Claims, 4 Drawing Sheets

FIG. 4

83

CONTROL VARIABLE SPECIFIC TABLE

| | HEATER 1 | HEATER 2 | HEATER 3 | HEATER 4 | HEATER 5 | HEATER 6 | ····· |
|---|---|---|---|---|---|---|---|
| Tb1-11 | CONTROL AMOUNT 1-11 | CONTROL AMOUNT 2-11 | CONTROL AMOUNT 3-11 | CONTROL AMOUNT 4-11 | CONTROL AMOUNT 5-11 | CONTROL AMOUNT 6-11 | |
| Tb1-21 | CONTROL AMOUNT 1-21 | CONTROL AMOUNT 2-21 | CONTROL AMOUNT 3-21 | CONTROL AMOUNT 4-21 | CONTROL AMOUNT 5-21 | CONTROL AMOUNT 6-21 | |
| Tb1-31 | CONTROL AMOUNT 1-31 | CONTROL AMOUNT 2-31 | CONTROL AMOUNT 3-31 | CONTROL AMOUNT 4-31 | CONTROL AMOUNT 5-31 | CONTROL AMOUNT 6-31 | |
| Tb1-41 | CONTROL AMOUNT 1-41 | CONTROL AMOUNT 2-41 | CONTROL AMOUNT 3-41 | CONTROL AMOUNT 4-41 | CONTROL AMOUNT 5-41 | CONTROL AMOUNT 6-41 | |
| Tb1-51 | CONTROL AMOUNT 1-51 | CONTROL AMOUNT 2-51 | CONTROL AMOUNT 1-51 | CONTROL AMOUNT 4-51 | CONTROL AMOUNT 5-51 | CONTROL AMOUNT 6-51 | |
| Tb1-61 | CONTROL AMOUNT 1-61 | CONTROL AMOUNT 2-61 | CONTROL AMOUNT 3-61 | CONTROL AMOUNT 4-61 | CONTROL AMOUNT 5-61 | CONTROL AMOUNT 6-61 | |
| Tb1-71 | CONTROL AMOUNT 1-71 | CONTROL AMOUNT 2-71 | CONTROL AMOUNT 3-71 | CONTROL AMOUNT 4-71 | CONTROL AMOUNT 5-71 | CONTROL AMOUNT 6-71 | |
| Tb1-81 | CONTROL AMOUNT 1-81 | CONTROL AMOUNT 2-81 | CONTROL AMOUNT 3-81 | CONTROL AMOUNT 4-81 | CONTROL AMOUNT 5-81 | CONTROL AMOUNT 6-81 | |
| ⋮ | | | | | | | |

FIG. 5

81

SELECTION TABLE

| | | FIRST SENSOR | | | | | | | |
|---|---|---|---|---|---|---|---|---|---|
| | | ~ -10°C | ~ -20°C | ~ -30°C | ~ -40°C | ~ -50°C | ~ -60°C | ~ -70°C | ~ -80°C |
| SECOND SENSOR | ~ -10°C | Tb1-11 | Tb1-12 | Tb1-13 | Tb1-14 | Tb1-15 | Tb1-16 | Tb1-17 | Tb1-18 |
| | ~ -20°C | Tb1-21 | Tb1-22 | Tb1-23 | Tb1-24 | Tb1-25 | Tb1-26 | Tb1-27 | Tb1-28 |
| | ~ -30°C | Tb1-31 | Tb1-32 | Tb1-33 | Tb1-34 | Tb1-35 | Tb1-36 | Tb1-37 | Tb1-38 |
| | ~ -40°C | Tb1-41 | Tb1-42 | Tb1-43 | Tb1-44 | Tb1-45 | Tb1-46 | Tb1-47 | Tb1-48 |
| | ~ -50°C | Tb1-51 | Tb1-52 | Tb1-53 | Tb1-54 | Tb1-55 | Tb1-56 | Tb1-57 | Tb1-58 |
| | ~ -60°C | Tb1-61 | Tb1-62 | Tb1-63 | Tb1-64 | Tb1-65 | Tb1-66 | Tb1-67 | Tb1-68 |
| | ~ -70°C | Tb1-71 | Tb1-72 | Tb1-73 | Tb1-74 | Tb1-75 | Tb1-76 | Tb1-77 | Tb1-78 |
| | ~ -80°C | Tb1-81 | Tb1-82 | Tb1-83 | Tb1-84 | Tb1-85 | Tb1-86 | Tb1-87 | Tb1-88 |

TEMPERATURE CONTROL METHOD OF HEAT DEVELOPING APPARATUS AND HEAT DEVELOPING APPARATUS

BACKGROUND OF THE INVENTION

1. Field of the Invention

The present invention relates to a heat developing apparatus in which a heat processing section to heat develop a heated developing sheet on which a latent image by an exposure is formed, is opened toward the outside of the apparatus by the opening and closing of an opening and closing cover, and particularly to the control technique of the rising temperature of the heat processing section.

2. Description of the Related Art

In a plate making image forming apparatus for making a plate-making for printing, or an image forming apparatus to record a medical image such as a Computed Tomography or Magnetic Resonance, an image forming apparatus by using a dry system which forms the image by the heat developing, without conducting the wet processing, is remarked. In such the image forming apparatus, a photosensitive and/or heat sensitive recording material (photosensitive heat sensitive recording material) or film of heat developing photosensitive material (hereinafter, called heated developing sheet) is used, and a latent image formed by irradiating (scanning) the laser beams, is developed by the heat, and the image is formed. In the image forming apparatus by such the dry system (hereinafter, called heat developing apparatus), not only the image formation can be attained in a shorter time than the wet processing, but a problem of waste solution processing can also be eliminated, and it is fully presumed that the demand will be increased in the future.

Conventionally, this heat developing apparatus is structured, as a main structure, by a conveyer to supply and convey the heated developing sheet after the latent image formation, preliminary heating section to preliminarily heat, main heating section corresponding to a developing section, gradually cooling section to gradually cool the heated developing sheet which is heat developed by the main heating section, and exhaust section to exhaust the gas generated in the apparatus.

The preliminary heating section is structured in such a manner that a plurality of roller units each of which is structured by a heating roller and a conveying roller, are arranged at an equal interval along the conveying direction of the heated developing sheet. The closer a heating roller is to the main heating system, the higher the heating temperature of the heating roller is, and it is set so that, when the heated developing sheet passes the heating roller closest to the main heating section, the temperature of the heated developing sheet is increased to the developing temperature.

The main heating section is structured in such a manner that a plurality of heating units in which a heat plate and a plurality of conveying rollers and sub-heater are arranged, are arranged along the conveying direction of the heated developing sheet. The heated developing sheet is nipped by the heat plate and the conveying roller, and heated at the developing temperature while being conveyed, and advances to the gradually cooling section side.

The gradually cooling section is structured in such a manner that a slanting section is arranged between a sending roller structured by a pair of conveying rollers, and a delivery roller structured by a pair of conveying rollers. The falling speed of the heated developing sheet after development is adjusted in the gradually cooling section by the sending roller and the delivery roller, and the sheet is gradually cooled to about the room temperature at a predetermined cooling speed.

According to the heat developing apparatus structured as described above, because the apparatus is provided with the preliminary heating section and the gradually cooling section, the quick temperature change (quick temperature rise and down) is not caused on the heated developing sheet, and the developing is smoothly and surely conducted. That is, in the preliminary heating section, at the temperature difference by which the developing unevenness due to the deformation of the substrate of the heated developing sheet is not generated, the sheet is preliminarily heated to the developing temperature in stages. Accordingly, in the main heating section, because the temperature of the sheet is not instantaneously raised from a low temperature to the developing temperature, the generation of the developing unevenness due to the large deformation of the substrate is suppressed. Then, because the gradually cooling is conducted in the gradually cooling section, the generation of the wrinkle or lowering of the image quality due to the quick temperature down is prevented.

In the heat developing apparatus, at the time of start from the unused condition, or the start after return from the jam, the quick responsibility of the startup temperature and the temperature stability is required. However, in an ordinary PID (Proportional, Integral, Derivative) control or ON/OFF control, the temperature of the heater and the portion near the heater is stabilized soon, but the response of the temperature of the portion apart from the heater is slow. Therefore, in order to raise the temperature to the predetermined temperature soon, it is conducted that the temperature of the heater is raised to the higher temperature than the stable temperature once. In the temperature control method in this case, the raised temperature and the raising time are controlled amounts.

However, conventionally, at the time of startup, the temperature drop amount at the time of startup is detected by one temperature sensor, and corresponding to that, the control amount is set. Because of that, the temperature control method can cope with the temperature around the detecting portion, however, to the temperature of the other portions, it is not always the optimum control amount. For example, even when the apparatus is started in the same manner, the two kinds of temperature drops cannot be distinguished from each other. That is, a case where the start is a start from the condition that the opening and closing cover is closed (power source is turned off), or a case where the operating apparatus is stopped once when the cover is opened by the jam, and after the restore from the jam, the apparatus is started again, are not distinguishable. Accordingly, in the latter case, when the controlled amounts are set to the same as in the former case, the portion at which the temperature is too high is generated.

SUMMARY OF THE INVENTION

In view of the foregoing, the present invention is attained, and the object of the present invention is to provide a temperature control method of a heat developing apparatus by which, for various operating conditions of the apparatus, the optimum temperature control amounts can be determined, and a heat developing apparatus, and thereby, to secure the quick responsibility of the startup temperature.

A temperature control method of the heat developing apparatus according to the first aspect of the present invention to attain the above object, is a temperature control method of a heat developing apparatus in which a heat processing section to conduct the heat developing on a heated developing sheet on which a latent image by the exposure is formed, is opened toward the apparatus outside by an opening and closing motion of an opening and closing cover, wherein a temperature detection is conducted by a first sensor which is arranged in the vicinity of a conveying path of the heated developing sheet of the heat processing section and to be exposed to the outside of the apparatus when the opening and closing cover is opened; simultaneously, a temperature detection is conducted by the second sensor which is arranged in the heat processing section and to be kept unexposed to the outside of the apparatus when the opening and closing cover is opened; and an optimum combination of a control variable and a control amount is selected from predetermined combination of control variables and control amounts corresponding to the combination of each temperature detected by the first and the second sensor, and the temperature control of the heat processing section is conducted at the time of the start of the apparatus operation according to the selected optimum control variable,.

In this temperature control method of the heat developing apparatus, the temperature is detected by the first sensor provided in a portion where temperature change is large, and the second sensor provided in a portion where temperature change is small. Further, the optimum control variable is previously stored corresponding to the combination of each temperature by the first sensor and the second sensor, and at the time of the start of the apparatus operation, the optimum control variable is selected corresponding to each temperature detected by the first and the second sensors, and the temperature control of the heat processing section is conducted by the optimum control variable. Thereby, the discrimination of the temperature lowering condition in the various using condition which cannot be conducted by the temperature detection by one sensor can be conducted, and the setting of the control variable can be exactly conducted, and the delay to the temperature stabilization is hardly generated. Particularly, because the opening and closing condition and the closing condition of the opening and closing cover can be discriminated, the optimum control variable can be exactly obtained, and the temperature of the heat processing section can be quickly stabilized.

A temperature control method of the heat developing apparatus according to the second aspect of the present invention is similar to the temperature control method of the heat developing apparatus of the first aspect of the present invention, except that the optimum combination of control variables and control amounts are selected based on a combination of temperature drops measured by the first and second sensors.

According to the temperature controlling method of the second aspect, it is possible to detecting the temperature drop condition to further enable an apparatus with said method to more accurately determine the status under which the apparatus is working, eventually enabling rapid stabilization of the temperature in the heat processing unit.

A heat developing apparatus of the third aspect of the present invention is a heat developing apparatus which is provided with a heat processing section to heat develop a heated developing sheet on which the latent image is formed by an exposure, and the opening and closing cover to expose the heat processing section toward the outside of the apparatus, wherein the heat developing apparatus has: a first sensor to be disposed in the vicinity of a conveying path of the heated developing sheet of the heat processing section and to be exposed to the outside of the apparatus when the opening and closing cover is opened; the second sensor to be arranged in the heat processing section and to be kept unexposed to an outside of the apparatus when the opening and closing cover is opened; a memory means to memorize combinations of predetermined control variables and control amounts in correspondence with the combination of each temperatures measured by the fist and the second sensor; and a control means to select the combination of optimum control variable and control amount at the time of the start of the apparatus operation corresponding to the combination of each temperature detected by the first and the second sensor, and the heating control of the heat processing section is conducted according to the combination of the optimum control variables and the optimum control amounts which are selected.

In this heat developing apparatus, by the first sensor and the second sensor, the temperature of a portion where temperature change is large when the opening and closing cover is opened, and the temperature of a portion where temperature change is small even when the opening and closing cover is opened, are detected. Then, the combination of the optimized control variables and the optimized control amounts corresponding to respective combinations of the detected temperatures are selected from the memory means by the control means. In the heat processing section, according to the selected control variables and control amounts, the heating control is conducted by the control means. That is, according to the combination of each temperature, the various apparatus conditions can be grasped. Thereby, the temperature can be quickly stabilized by the combination of the optimum control variables and the optimum control amounts, and as the result, the quick responsibility of the startup temperature can be secured.

A heat developing apparatus of the fourth aspect of the present invention is similar with the heat developing apparatus of the third aspect, except that the combination of the optimum control variables and the optimum control amounts are selected based on the combination of the temperature drops measured by the first and second sensors.

According to the apparatus of the fourth aspect of the present invention, various apparatus condition changes can be grasped and the temperature can be stabilized quickly by the combination of the optimum control variables and the optimum amounts selected based on the temperature drops.

A heat developing apparatus of the fifth aspect of the present invention is characterized in that: the combination of the optimum control variables and the optimum control amounts is a combination of control variables and control amounts by which a heating temperature to each of a plurality of heating bodies existing in the heat processing section is respectively set, corresponding to the combination of the temperature drop amount from the temperature of the heat processing section before the opening of the opening and closing cover to each temperature detected by the first and second sensors at the time of opening of the opening and closing cover.

In this heat developing apparatus, for example, although the temperature lowering amount of the second sensor is small, when the temperature lowering amount of the first sensor is large, it is judged that the heat processing section is opened. The heating means is heating controlled by the combination of control variables and control amounts corresponding to the combination of the temperature drop amount, the heating of the heater is not conducted for which the heating is not necessary, and the minimum necessary heaters are heated and the temperature of the heat processing section is stabilized at a short time.

A heat developing apparatus of the sixth aspect according to the present invention is characterized in that the control variables and control amounts are selected from a previously set table which can be looked up with a combination of the temperature drop amounts detected by the first and the second sensors.

In this heat developing apparatus, when the temperature drop amounts are detected by the first sensor and the second sensor, the combination of optimized control variables and optimized control amounts corresponding to the combination of the temperature drops is instantaneously specified from the table stored in the memory means. Accordingly, it is not necessary that the control variable stored in the table is a control variable having particularly the regularity, and for example, the control variable may be a proper control variable corresponding to respective combinations obtained by the experiment. Further, by storing the data of the combinations of the control variables and the control amounts in the form of the table, the table can be easily diverted to the other apparatus in which the structure of the heat processing section or the opening and closing condition is different, by partially changing the data.

A heat developing apparatus of the seventh aspect according to the present invention is characterized in that the control variable is set by the previously set function to each temperature drop amount detected by the first and the second sensors.

In this heat developing apparatus, when the temperature drop amounts are detected by the first and second sensors, from the function stored in the memory means, the optimized control amounts for predetermined combination of control variables, corresponding to the combination of the temperature drop amounts, is calculated and specified. Accordingly, an amount of the data stored in the table can be reduced, and further, the control variable can be precisely set.

BRIEF DESCRIPTION OF THE DRAWINGS

FIG. 3A shows the side view in a condition that an opening and closing cover is closed, and FIG. 3B shows the side view in a condition that the opening and closing cover is opened.

FIG. 4 is a view of the selected control variable table and a control variable specific table for specifying the control variable corresponding to each heating means.

FIG. 5 is a view of a selection table for specifying a control variable table corresponding to combinations of detection values of the first sensor and the second sensor.

DESCRIPTION OF THE PREFERRED EMBODIMENTS

Figure 1:
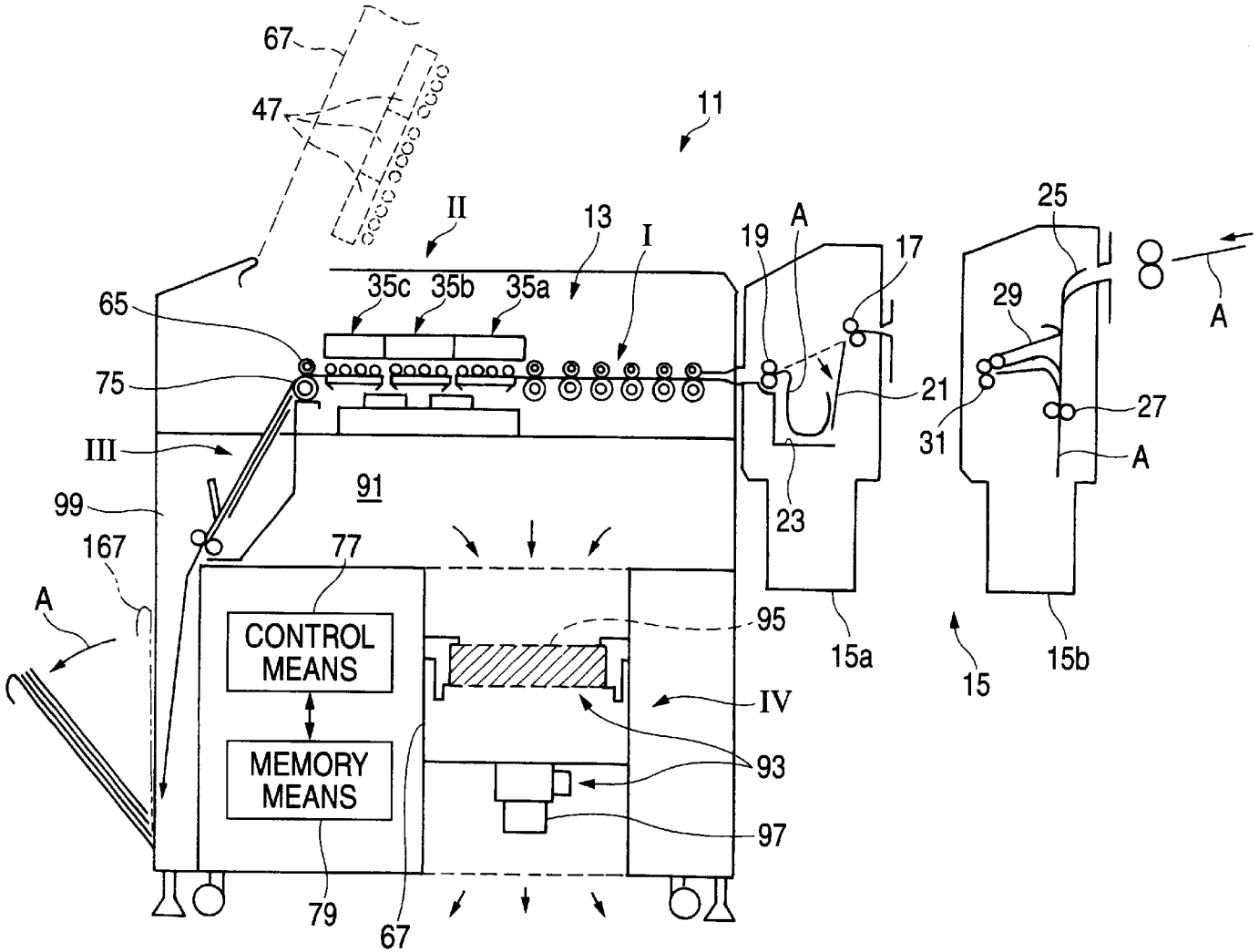
FIG. 1 is a schematic structural view showing an embodiment of a heat developing apparatus according to the present invention.

Referring to the drawings, the temperature control method of the heat developing apparatus of the present invention and preferred embodiments of the heat developing apparatus will be detailed below.

Figure 2:
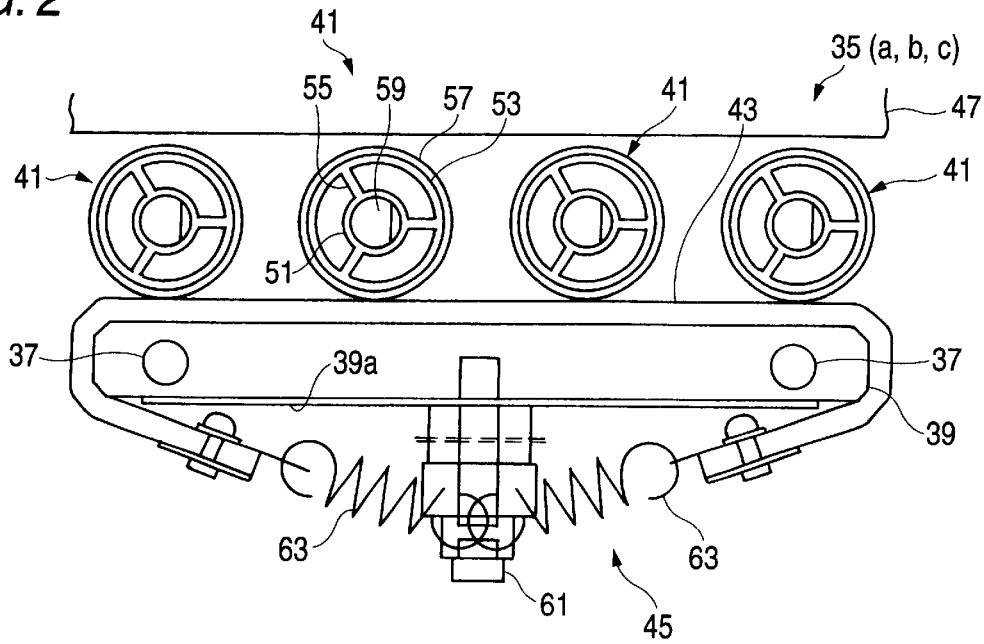
FIG. 2 is an enlarged side view of a main portion of a main heating section.
Figure 3A:
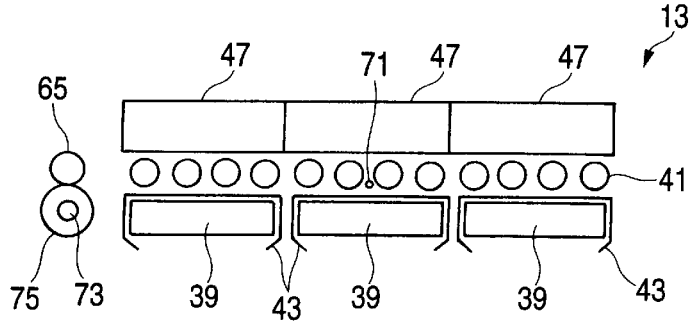
FIGS. 3A and 3B are side views of the main heating section and a gradually cooling section.
Figure 3B:
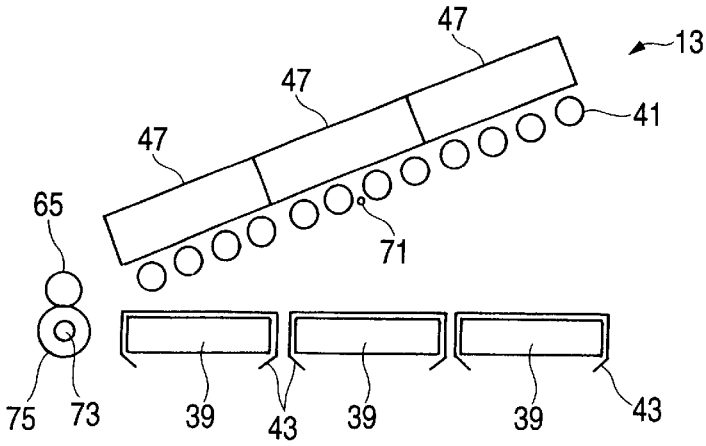

FIG. 1 is a schematic structural view showing an embodiment of the heat developing apparatus according to the present invention. FIG. 2 is a main portion enlarged side view of the main heating section. FIGS. 3A and 3B are side views of a main heating section and a gradually cooling section. FIG. 3A shows a condition that the opening and closing cover is closed, and FIG. 3B shows a condition that the opening and closing cover is opened. FIG. 5 is a view of the selection table to specify the control amount table corresponding to the combination of the detection values of the first sensor and second sensor, and FIG. 4 is a view of the control variable specific table to specify the control variable corresponding to the selected control variable table and each heating means.

A heat developing apparatus 11 heats the heated developing sheet A, and as the heated developing sheet, for example, the news paper plate making recording material whose size is large and whose thickness is thin, can be listed. The heat developing apparatus 11 has, as the main structure, a preliminary heating means (preliminary heating section) I to pre-heat the heated developing sheet A, a main heating section II corresponding to the developing section, a gradually cooling section III, and an exhaust section IV to exhaust the gas generated in the apparatus. The preliminary heating section I, main heating section II, and gradually cooling section III structure a heat processing section 13.

To the heat developing apparatus 1, a conveyer 15 which is an interface to supply the heated developing sheet A which is exposure-scanned in a plotter, not shown, and on which a latent image is formed, is connected. In the conveyer 15, there is a conveyer 15*a* in which, for example, the heated developing sheet A of A1/A2 size can be commonly used, and by which the sheet supply speed from the plotter is reduced, or a conveyer 15*b* in which the heated developing sheet A of A2 size can be exclusively used, and by which the reversing processing of the front and rear surfaces can be conducted. In the heat developing apparatus 11, these conveyers 15*a* and 15*b* are appropriately connected corresponding to the purpose.

An outline of this conveyer will be described below. The conveyer 15*a* has a suction side nip roller 17 which is in timed relationship with the sheet conveying speed of the plotter, and a delivery side nip roller 19 whose speed is lower than the suction side nip roller and which is in timed relationship with the sheet conveying speed of the heat developing apparatus 11, and on the conveying path between them, a guide plate 21 which is oscillatable below is provided. On the conveyer 15*a,* when the heated developing sheet A conveyed by the suction side nip roller 17 arrives at the delivery side nip roller 19 and is nipped, the guide plate 21 is oscillated below, and the heated developing sheet A becomes loop-like and slacks up in a accommodation section 23, and the difference of the sheet conveying speed in the heat developing apparatus 11 and the plotter is absorbed.

Further, the conveyer 15*b* has a vertical guide portion 25 to convey the heated developing sheet A supplied from the plotter perpendicularly toward a below portion, a reversing nip roller 27 provided on a lower end of the slanting guide portion 25, a horizontal guide portion 29 connected to about the center of the vertical guide portion 25, and a delivery side nip roller 31. On this conveyer 15*b*, the heated developing sheet A supplied from the plotter is bent by the vertical guide portion 25 and conveyed toward a lower direction by the nip roller 27. When the trailing edge of the heated developing sheet A becomes a predetermined height, the sheet a is separated from the vertical guide portion 25 by the self weight, and falls on the horizontal guide portion 29. When the reversing nip roller 27 is reversed under this condition, the heated developing sheet A is conveyed along the horizontal guide portion 29, and when the sheet A is nipped by the delivery side nip roller 31, the front and rear sides of the sheet A are reversed, and the sheet A is supplied to the heat developing apparatus 11.

In this manner, the heated developing sheet A whose speed is adjusted or which is reversing processed, by the conveyer 15, initially passes the preliminary heating section I. The preliminary heating section I is structured by a plurality pairs of nip rollers which are heat rollers, and heats the heated developing sheet A and gradually increases the temperature to the heat developing temperature.

The heated developing sheet A whose temperature is increased to the heat developing temperature in the preliminary heating section I, is conveyed in succession to the main heating section II. In the main heating section II according to the present embodiment, 3 same shaped units 35 (35*a*, 35*b*, 35*c*) are parallely arranged in the sheet conveying direction. As shown in FIG. 2, the unit 35 is provided with: a heat plate 39 which is a heating body supported by a supporting axis 37; a roller 41 which is a press transferring means by which the heated developing sheet A is pressed on the surface of the heat plate 39 and slidingly moved; a cushion member 43 which is provided on the surface of the heat plate 39 and by which the pressing force of the roller 41 onto the heated developing sheet A is softened; a pulling means 45 to provide the tension onto the cushion member 43; and a sub-heating body 47 arranged on the opposite side of the heat plate 39 sandwiching the roller 41.

The heat plate 39 of this embodiment is a flat plate. In the heat plate 39, the material of the surface contacting with the heated developing sheet A is a heating body, and a rubber heater 39 is adhered onto the rear side of the surface, and the heated developing sheet A is heated in a maintainable manner, to the developing temperature. Other than this, the heat plate 39 may be a plate-like heating member in which the heat generating body such as a nichrome wire is housed by being flatly laid, or a heating system one in which the hot air or a halogen lamp is a heat source.

The roller 41 may be one, but, more preferably, a plurality of rollers are provided, and come into contact with the one surface of the heat plate 39 through the cushion member 43. When, in the roller 41, an inner wheel 51 and an outer wheel 53 are connected by a rib 55, the heat conductivity between the inner wheel 51 and outer wheel 53 is increased. The heat conductivity of the roller 41 is appropriate in the range of 0.1–200 W/m/° C. Onto the outer periphery of the outer wheel 53, a silicon rubber 57 is adhered. The roller 41 is rotatably supported at the fixed position when a fixed axis 59 is inserted into the inner wheel 51. When the roller 41 has a higher frictional coefficient to the heated developing sheet A than that of the surface of the cushion member 43 to the heated developing sheet A, the heated developing sheet A is securely transferred.

The cushion member 43 may be a fabric sheet composed of, for example, collected fine string materials. As the fabric sheet, the natural fiber and chemical fiber may be used. As the natural fiber, the plant fiber, animal fiber, or mineral fiber may be used, and as the chemical fiber, a regeneration fiber, semi-synthetic fiber, synthetic fiber, or inorganic fiber, may be used. However, in any case, it is a condition that the fiber satisfies the predetermined low friction, heat resistance, and elasticity. As the condition, under the temperature circumstance of about 120° C. which is, for example, the circumstance temperature of the main heating section II, the fiber which has the elasticity, and can secure the frictional resistance smaller than the frictional resistance between the heated developing sheet A and the roller 41, is preferable.

Onto the cushion member 43, the tension is provided by the pulling means 45. Specifically, supporting pins 61 are protruded on both ends of the conveying direction of the heat plate lower surface. This supporting pins 61 are arranged at the outside of the sheet conveying direction from the cushion member 43. One ends of draft springs 63 are fixed to both end portions of the cushion member, and the other ends of respective draft springs 63 are engaged with the supporting pins 61. Accordingly, when the cushion member 43 is pulled by the draft springs 63, the tension is always provided to the cushion member 43, and even when the deviation is generated in the relative position due to the difference of the coefficient of thermal expansion between the heat plate 39 and the cushion member 43, the wrinkle is not generated in the cushion member 43.

In the main heating section II according to the embodiment, sub-heating bodies 47 are arranged oppositely to respective heat plates 39 with the rollers 41 between them. In the main heating section II, it is structured that 60–70% of all heating amount are shared by the heat plates 39, and 40–30% of all heating amount are shared by sub-heating bodies 47. As described above, when the sub-heating bodies 47 are provided also on the opposite side of the heat plates 39 with the rollers 41 between them, the temperature difference becomes small on the sheet front and rear, and the heated developing sheet A is more uniformly heated, and the developing unevenness is hardly generated. in this connection, in this embodiment, the sub-heating body 47 is arranged in no-contact with the roller 41. As the heating system, a heat plate system in which the heat generation body such as the nichrome wire is flatly laid and housed inside it, the air blasting system by the hot air, or a radiation system in which a halogen lamp is a heat source, may be used.

The gradually cooling section III is arranged on the downstream side of the sheet conveying direction of the main heating section II, and after the heated developing sheet A is heat developing processed in the main heating section II, it is conveyed to the gradually cooling section III by the nip rollers 65 and cooled. In this manner, the heated developing sheet A on which the heat processing is completed, is delivered from the exit, and stacked on the film receiving tray 167 provided outside the apparatus.

In order to cope with the jam of the sheet in the apparatus, the heat developing apparatus 11 is structured in such a manner that the heat processing section 13 is opened and the sheet conveying path is exposed toward the outside of the apparatus. That is, the opening and closing cover 67 is provided on the upper surface of the apparatus so that it can be opened and closed. By the opening and closing cover 67, at least the sub-heating body 47 of the main heating section II and the roller 41. Accordingly, the apparatus is structured in such a manner that, when the opening and closing cover 67 is opened, the sub-heating body 47 and the roller 41 are moved upward together with the opening and closing cover 67, and the cushion member 43 is exposed. That is, the apparatus is structured in such a manner that the sheet conveying path between the cushion member 43 and the roller 41 is opened, thereby, the jammed sheet is easily removed.

Accordingly, the sub-heating body 47 and the roller 41 is exposed toward the outside of the apparatus when the opening and closing cover 67 is opened. On the one hand, even when the opening and closing cover 67 is opened, the gradually cooling section III of the heat processing section 13 is not directly exposed toward the outside of the apparatus except for the nip roller 65. In this connection, in the above example, a case in which only the main heating section II is opened by the opening and closing cover 67, is shown in the drawing, however, it may also be of course allowable that the heat processing section 13 is the section in which the sub-heating section I can also be opened by the other opening and closing cover.

As shown in FIGS. 3A and 3B, in the vicinity of the roller 41 of the opening and closing cover 67 which is the vicinity of the sheet conveying path of the heat processing section 13, the first sensor 71 which is exposed (bared) toward the out side of the apparatus when the opening and closing cover 67 is opened, is provided. The first sensor 71 arranged at almost central portion of the heated developing sheet conveying direction of the sub-heating body 47 provided on the opening and closing cover 67. The sub-heating body 47 provided on the opening and closing cover 67 is separated from the heat processing section 13 and is exposed to the outside air when the opening and closing cover 67 is opened. Accordingly, when the opening and closing cover 67 is opened by the jam processing during the operation of the apparatus, because the temperature of the sub-heating body 47 is high, it is cooled by the outside air. In this case, the temperature of the sub-heating body 47 is as sooner lowered by the influence of the outside air as it goes to the outer periphery side, and as it goes to the central portion, the temperature lowering is as later by its own thermal capacity. That is, the first sensor 71 arranged at almost central portion of the conveying direction of the heated developing sheet is not directly influenced by the outside air, and the temperature measurement of the sub-heating body 47 itself which is under the temperature lowering condition, becomes possible. That is, the temperature of the outside air is not detected, but the temperature measurement of the sub-heating body 47 under the temperature lowering condition can be high accurately conducted.

Further, in the heat processing section 13, the second sensor 73 which is not exposed toward the apparatus outside, even when the opening and closing cover 67 is opened, is provided at the portion except for the opening and closing cover 67. That is, the second sensor 73 is hardly exposed to the outside air, even when the opening and closing cover 67 is opened, and provided at the portion whose temperature change is small. In the present embodiment, the second sensor 73 is provided on the gradually cooling roller 75 which comes into contact from below with the nip roller 65 of the gradually cooling section III.

Because the gradually cooling section III has the function to gradually cool the heated developing sheet A which is heat developed, the temperature is set in such a manner that it is higher than the no-heating members, and lower than the heat developing temperature. Further, even when the opening and closing cover 67 is opened, it is not directly exposed in the outside air like as the heating means provided on the opening and closing cover 67, and its temperature lowering width is smaller than the heating means of the heat developing section. Therefore, even when the opening and closing cover 67 is opened and the power supply is turned off, the temperature is gradually lowered, and the temperature measurement not influenced by opening of the opening and closing cover 67 can be conducted.

A control means (CPU) 77 to which the first sensor 71 and the second sensor 73 are connected, is provided in the heat developing apparatus II. When the control means 77 receives the start signal from a main body control section, not shown, at the operation start of the apparatus, the temperature detection is conducted by the first sensor 71 and the second sensor 73, and the temperature lowering amount form the predetermined heat developing temperature is calculated. Thereby, the starting which cannot be discriminated conventionally, can be discriminated as follows: it can be discriminated whether the starting is the first one from the condition in which the opening and closing cover 67 is closed, or whether it is the re-starting after the cover of the apparatus is opened by the jam, and the operation is stopped once.

Then, a memory means (ROM) 79 is connected to the control means 77. In the memory means 79, the control variables and control amounts which are optimized corresponding to respective combinations of the temperature lowering amounts detected by the first sensor 71 and the second sensor 73, is stored. These control variables and control amounts are stored as the table composed of a plurality of data groups specified corresponding to respective combinations of the temperature lowering amounts detected by the first sensor 71 and the second sensor 73.

In the present embodiment, this table is composed of a selection table 81 shown in FIG. 5, and a control variable specific table 83 shown in FIG. 4. The selection table 81 is a table for specifying the control variable table corresponding to the combinations of the detected values of the first sensor 71 and the second sensor 73. Further, the control variable specific table 83 is a table for specifying the selected control variable table, and also specifying the control variable and value for the said control variables corresponding to each heating means (heat plate 39, sub-heating body 47). The control means 77 selects the optimized control variable and value for it from these selection table 81 and the control variable specific table 83, stored in the memory means 79, and according to this control variable, heating controls the heating means of the heat processing section 13.

Specifically, for example, when the temperature lowering amount detected by first sensor is −10° C. , and the temperature lowering amount detected by the second sensor is −20° C. , from the selection table shown in FIG. 4, Tbl-21 is selected. Next, the control means 77 selects from the control variable specific table 83 shown in FIG. 4, the control variables of each heating means (heaters 1–6) corresponding to Tbl-21, that is, control variable 1–21, control variable 2–21, control variable 3–21, control variable 4–21, control variable 5–21, control variable 6–21, and according to these control variables, it heating controls the heating means (heaters 1–6) of the heat processing section 13. In this connection, the heaters 1–6 are described as an example of the heating means, not shown, provided at an arbitrary position in the heat processing section 13, and it does not always coincide with the number of the actual heating means.

It is not necessary that the control variable and value stored in the control variable specific table 83 has particularly the regularity, but it may be a proper control variable and value corresponding to respective combinations, for example, obtained by experiments. Further, when the data groups of the control variables and values are stored in a form of table, for also the other devices in which the structure of the heat processing section 13 or the opening and closing condition of the opening and closing cover 67 is different, by partially changing the data groups, the diversion of the selection table 81 and the control variable specific table 83 can be easily conducted. Further, the optimum control variable corresponding to the detection temperature obtained from the first and the second sensors 71 and 73 can be instantaneously specified.

In the memory means 79, excepting that the control variable data is stored in the type of above table form, the function in which the temperature lowering amount and the control variable are parameters, may also be stored. In this case, the control variable can be obtained when the detected temperature lowering amount is substituted and calculated by the control means 77. Thereby, the data amount to be stored in the memory means 79 can be reduced, and the control variable can be precisely set.

In this connection, in the heat developing apparatus 11, the above described exhaust section IV to exhaust the volatile substance generated when the heated developing sheet A is developed, in the lower density than the regulated density to the outside of the apparatus, is provided. The exhaust section IV is composed of a chamber section 91 formed by the hermetic structure at about the central portion of the heat developing apparatus 11, and the exhaust means 93 arranged in the chamber section 91. In the chamber section 91, the lower portion is opened to the outside of the apparatus, and on the one hand, the upper portion is opened to the preliminary heating section I, main heating section II, and gradually cooling section III. The exhaust means 93 is composed of the deodorizing filter 95, and exhaust fan 97. These deodorizing filter 95 and exhaust fan 97 are successively arranged in the chamber section 91 from the upper portion opening side to the lower portion opening side.

Accordingly, when the exhaust fan 93 is driven, the air in the chamber section 91 is exhausted to the outside of the apparatus, and according this, into the chamber section 91 in which the pressure is negative, the air in the apparatus flows. Thereby, the pressure in the apparatus is kept to negative. When, the pressure in the apparatus is negative, the air from the outside flows into the apparatus. For this outside air flow inlet, the sheet delivery port 99 whose air resistance is small, is mainly used. The air flowed from the sheet delivery port 99 is introduced to the deodorizing filter 95 mainly through the gradually cooling section III. Accompanied by this, the volatile substance generated in the preliminary heating section I, and main heating section II, is sucked into the chamber section 91, and through the deodorizing filter 95, and becomes the density lower than the regulated density, and is exhausted to outside the apparatus by the exhaust fan 97.

According to the temperature control method by using the heat developing apparatus 11 structured as described above, the temperature detection is conducted by the first sensor 71 provided at the portion whose temperature change is large, and the second sensor 73 provided at a portion whose temperature change is small, and the optimum control variable corresponding to respective combinations of the temperature lowering amount by the first sensor 71 and the second sensor 73, is previously stored, and when the operation of the apparatus is started, because the temperature control of the heat processing section 13 is controlled by the optimized control variable selected from the temperature lowering amount of the first sensor 71 and the second sensor 73, the discrimination of the temperature lowering condition under various using conditions which can not be discriminated by the temperature detection by using one sensor, can be conducted. Accordingly, even when, conventionally, the apparatus is started in the same manner, although it can not be discriminated whether the starting is the first starting from the condition in which the opening and closing cover 67 is closed for a long time, or whether it is the re-starting after the operation of the apparatus is stopped once by the jam, the discrimination whether it is the starting from the unused condition, and whether it is the starting after the jam restoring, can be conducted. As the result, by the optimum control variable, the temperature of the heat processing section 13 can be quickly stabilized.

As detailed above, according to the temperature control method of the heat developing apparatus according to the present invention, the temperature detection is conducted by the first sensor provided at the portion whose temperature change is large, and the second sensor provided at a portion whose temperature change is small, and the optimum control variable corresponding to respective combinations of the temperature lowering amount by the first sensor and the second sensor, is previously stored, and when the operation of the apparatus is started, because the temperature control of the heat processing section is controlled by the optimized control variable selected from the temperature lowering amount of the first sensor and the second sensor, the discrimination of the temperature lowering condition under various using conditions which can not be conducted by the temperature detection by one sensor, can be conducted. Accordingly, the discrimination, for example, whether the opening and closing cover is in opened condition or closed condition, can be conducted, and the temperature can be sooner stabilized by the optimum control variable, and as the result, the quick responsibility of the startup temperature can be secured.

According to the heat developing apparatus of the present invention, because the apparatus is provided with: the first sensor provided in the vicinity of the conveying path of the heated developing sheet of the heat processing section; the second sensor provided at a portion of the heat processing section whose temperature change is small even when the opening and closing cover is opened; a memory means for storing the control variable optimized corresponding to respective combinations of the temperature lowering amount detected by the first sensor ad second sensor; and a control means for selecting the optimized control variable from the memory means, and for heat controlling the heat processing section according to the selected control variable, various using conditions of the apparatus can be grasped by respective combinations of the temperature lowering amount detected by the first sensor and the second sensor. Thereby, the temperature can be quickly stabilized by the optimum control variable, and as the result, the quick responsibility of the startup temperature can be secured.

What is claimed is:

1. A temperature control method of a heat developing apparatus comprising a heat processing section to conduct heat developing on a heated developing sheet on which a latent image by an exposure is formed, is opened toward outside of an apparatus by an opening and closing motion of an opening and closing cover, which comprises:

first temperature detecting by a first sensor to be disposed in a vicinity of a conveying path of the heat developing sheet of the heat processing section and to be exposed to an outside of the apparatus when the opening and closing cover is opened;

second temperature detecting, at the same time with the first temperature detecting by the first sensor, by a second sensor to be arranged in the heat processing section and to be kept unexposed to an outside of the apparatus when the opening and closing cover is opened;

selecting an optimum combination of a control variable and a control amount from predetermined combinations of control variables and control amounts in correspondence with a combination of a result of the first temperature detection and a result of the second temperature detection; and controlling a temperature of the heat processing section based on the optimum combination of control variable and control amount, which is selected, at a time of the start of an apparatus operation.

2. A temperature control method of a heat developing apparatus comprising a heat processing section to conduct heat developing on a heated developing sheet on which a latent image by an exposure is formed, is opened toward outside of an apparatus by an opening and closing motion of an opening and closing cover, which comprises:

first temperature detecting by a first sensor to be disposed in a vicinity of a conveying path of the heat developing sheet of the heat processing section and to be exposed to an outside of the apparatus when the opening and closing cover is opened;

second temperature detecting, at the same time with the first temperature detecting by the first sensor, by a second sensor to be arranged in the heat processing section and to be kept unexposed to an outside of the apparatus when the opening and closing cover is opened;

selecting an optimum combination of a control variable and a control amount from predetermined combinations of control variables and amounts in correspondence with a combination of temperature drop down amounts of the first temperature detection and a result of the second temperature detection after an opening of said opening and closing cover; and controlling a temperature of the heat processing section based on the optimum combination of control variable and control amount, which is selected, at a time of the start of an apparatus operation.

3. A heat developing apparatus comprising a heat processing section to heat-develop a heated developing sheet on which a latent image is formed by an exposure, and an opening and closing cover to expose the heat processing section toward an outside of the apparatus, further comprising:

a first sensor to be disposed in a vicinity of a conveying path of the heat developing sheet of the heat processing section and to be exposed to an outside of the apparatus when the opening and closing cover is opened;

a second sensor to be arranged in the heat processing section and to be kept unexposed to an outside of the apparatus when the opening and closing cover is opened;

a memory means to memorize combinations of predetermined control variables and control amounts in correspondence with a combination of temperatures measured with the first sensor and a temperature measured with the second sensor; and a controlling means to select a combination of an optimum control variable and an optimum control amount from said memory means in correspondence with a combination of temperatures measured with each of the first and the second sensor, and to control a heating of the heat processing section based on the optimum control variable and amount, which is selected, at a time of the start of an apparatus operation.

4. A heat developing apparatus comprising a heat processing section to heat-develop a heated developing sheet on which a latent image is formed by an exposure, and an opening and closing cover to expose the heat processing section toward an outside of the apparatus, further comprising:

a first sensor to be disposed in a vicinity of a conveying path of the heat developing sheet of the heat processing section and to be exposed to an outside of the apparatus when the opening and closing cover is opened;

a second sensor to be arranged in the heat processing section and to be kept unexposed to an outside of the apparatus when the opening and closing cover is opened;

a memory means to memorize combinations of predetermined control variables and control amounts in correspondence with a combination of a temperature drop down measured with the first sensor and temperatures measured with the second sensor after an opening of said opening and closing cover; and a controlling means to select a combination of an optimum control variable and an optimum control amount from said memory means in correspondence with a combination of temperatures measured with each of the first and the second sensor, and to control a heating of the heat processing section based on the optimum control variable and amount, which is selected, at a time of the start of an apparatus operation.

5. A heat developing apparatus according to claim 4, wherein: the combination of the optimum control variable and the optimum control amount is a combination of a control variable and a control amount for each of a plurality of heating bodies existing in the heat processing unit to set a heating temperature in correspondence to a combination of temperature drops from a temperature of the heat processing unit before an opening of the opening and closing cover, to each temperature measured with the first and second sensors at a time of the opening of the opening and closing cover.

6. A heat developing apparatus according to claim 5, wherein: the combination of control variable and the control amount is selected from a table previously defined in correspondence to each combination of temperature drops measured with the first and second sensors.

7. A heat developing apparatus comprising a heat processing section to heat-develop a heated developing sheet on which a latent image is formed by an exposure, and an opening and closing cover to expose the heat processing section toward an outside of the apparatus, further comprising:

a first sensor to be disposed in a vicinity of a conveying path of the heat developing sheet of the heat processing section and to be exposed to an outside of the apparatus when the opening and closing cover is opened;

a second sensor to be arranged in the heat processing section and to be kept unexposed to an outside of the apparatus when the opening and closing cover is opened;

a memory means to memorize a function to compute combinations of control amounts for predetermined control variables in correspondence with a combination of a temperature drop down measured with the first sensor and a temperature measured with the second sensor after an opening of said opening and closing cover; and a controlling means to compute a combination of optimum control amounts for the predetermined combination of control variables with the function memorized in said memory means in correspondence with a combination of temperatures measured with each of the first and the second sensor, and to control a heating of the heat processing section based on the optimum control variable and amount, which is selected, at a time of the start of an apparatus operation.

8. A heat developing apparatus according to claim 7, wherein: the combination of the optimum control variable and the optimum control amount is a combination of a control variable and a control amount for each of a plurality of heating bodies existing in the heat processing unit to set a heating temperature in correspondence to a combination of temperature drops from a temperature of the heat processing unit before an opening of the opening and closing cover, to each temperature measured with the first and second sensors at a time of the opening of the opening and closing cover.

* * * * *